US010760773B2

(12) United States Patent
Zhang et al.

(10) Patent No.: US 10,760,773 B2
(45) Date of Patent: Sep. 1, 2020

(54) FOCUS-ADJUSTABLE LAMP

(71) Applicant: Jiangsu Sur Lighting Co., Ltd, Jiangsu (CN)

(72) Inventors: Haicheng Zhang, Jiangsu (CN); Honggui Xie, Jiangsu (CN); Zhengen Li, Jiangsu (CN); Yuejian Xun, Jiangsu (CN); Kanrui Han, Jiangsu (CN)

(73) Assignee: JIANGSU SUR LIGHTING CO., LTD, Jiangsu (CN)

( * ) Notice: Subject to any disclaimer, the term of this patent is extended or adjusted under 35 U.S.C. 154(b) by 120 days.

(21) Appl. No.: 16/086,562

(22) PCT Filed: Dec. 7, 2017

(86) PCT No.: PCT/CN2017/115006

§ 371 (c)(1),
(2) Date: Sep. 19, 2018

(87) PCT Pub. No.: WO2019/100448

PCT Pub. Date: May 31, 2019

(65) Prior Publication Data

US 2020/0173630 A1 Jun. 4, 2020

(30) Foreign Application Priority Data

Nov. 24, 2017 (CN) ..... 2017 1 1195058

(51) Int. Cl.
*F21V 14/00* (2018.01)
*F21V 29/507* (2015.01)
(Continued)

(52) U.S. Cl.
CPC ..... *F21V 14/006* (2013.01); *F21S 8/081* (2013.01); *F21V 17/104* (2013.01);
(Continued)

(58) Field of Classification Search
CPC ..... F21V 14/04; F21V 14/045; F21V 14/06; F21V 14/065; F21V 14/08; F21V 14/085;
(Continued)

(56) References Cited

U.S. PATENT DOCUMENTS 8,827,512 B1 * 9/2014 Beadle ..... F21S 8/083 362/153
9,964,286 B1 * 5/2018 Sooferian ..... F21V 9/40
(Continued)

FOREIGN PATENT DOCUMENTS

| | | | |
|---|---|---|---|
| CN | 200996560 | Y | 12/2007 |
| CN | 201661934 | U | 12/2010 |
| CN | 102537788 | A | 7/2012 |
| CN | 103335219 | A | 10/2013 |
| CN | 207486634 | U | 6/2018 |

*Primary Examiner* — Julie A Bannan
*Assistant Examiner* — Michael Chiang
(74) *Attorney, Agent, or Firm* — Seed IP Law Group LLP

(57) ABSTRACT

The present invention discloses a focus-adjustable lamp, provided with an illuminating mechanism on the top end thereof, wherein the illuminating mechanism comprises a light-emitting element, a shield body shielding the outer side of the light-emitting element, a heat dissipating member closely matched with the light-emitting element, and a cover body located on the top end of the illuminating mechanism, the illuminating mechanism is further provided with a light-converging cylinder rotationally sleeving the outer side of the shield body, and the light-converging cylinder is capable of rotating back and forth along a circumferential direction of the shield body to adjust the size of a light spot projected by the light-emitting element on the ground.

11 Claims, 10 Drawing Sheets

(51) Int. Cl.

| | |
|---|---|
| ***F21V 17/10*** | (2006.01) |
| ***F21V 17/16*** | (2006.01) |
| ***F21S 8/08*** | (2006.01) |
| *F21Y 115/10* | (2016.01) |
| *F21V 21/08* | (2006.01) |
| *F21W 131/109* | (2006.01) |

(52) U.S. Cl.
CPC ..... *F21V 17/164* (2013.01); *F21V 29/507* (2015.01); *F21V 21/0824* (2013.01); *F21W 2131/109* (2013.01); *F21Y 2115/10* (2016.08)

(58) Field of Classification Search
CPC .... F21V 14/006; F21V 29/507; F21V 17/104; G60Q 3/54; G60Q 3/57; B60Q 3/54; B60Q 3/57
USPC ..... 362/157
See application file for complete search history.

(56) References Cited

U.S. PATENT DOCUMENTS

| | | | | |
|---|---|---|---|---|
| 10,036,535 | B2 * | 7/2018 | Catalano | F21V 7/0066 |
| 2005/0135101 | A1 * | 6/2005 | Richmond | F21S 6/004 362/276 |
| 2010/0176750 | A1 * | 7/2010 | West | H05B 45/10 315/362 |
| 2012/0081901 | A1 * | 4/2012 | Tsang | F21V 14/06 362/277 |
| 2014/0022794 | A1 | 1/2014 | Laukkanen | |
| 2014/0218902 | A1 * | 8/2014 | Maglica | F21V 14/045 362/188 |
| 2015/0153025 | A1 * | 6/2015 | Wu | F21S 8/024 362/282 |
| 2015/0167953 | A1 * | 6/2015 | Huang | F21V 19/0035 362/294 |

* cited by examiner

FOCUS-ADJUSTABLE LAMP

CROSS-REFERENCE TO RELATED APPLICATION(S)

The present application claims the priority of Chinese Patent Application No. 201711195058.6, filed on Nov. 24, 2017, and entitled "Focus-adjustable Lamp," the content of which is incorporated herein by reference in its entirety.

BACKGROUND

Technical Field

The present invention relates to a focus-adjustable lamp, and in particular to a focus-adjustable lamp capable of changing the size of a light spot.

Description of the Related Art

There are small roads in parks and gardens, and there are often shorter path lights along the roads to illuminate the roads. However, the current path lights have a fixed illuminated spot size that cannot be adjusted as needed, thereby causing inconvenience in the use process.

In view of this, it is necessary to provide an improved focus-adjustable lamp to overcome the above problems.

BRIEF SUMMARY

An objective according to the present invention is to provide a focus-adjustable lamp capable of changing the size of a light spot.

In order to realize the above objective according to the present invention, the present invention provides a focus-adjustable lamp, provided with an illuminating mechanism on the top end thereof. The illuminating mechanism comprises a light-emitting element, a shield body shielding the outer side of the light-emitting element, a heat dissipating member closely matched with the light-emitting element, and a cover body located on the top end of the illuminating mechanism. The illuminating mechanism is further provided with a light-converging cylinder rotationally sleeving the outer side of the shield body. The light-converging cylinder is capable of rotating back and forth along a circumferential direction of the shield body to adjust the size of a light spot projected by the light-emitting element on the ground, the shield body is a lens having an outer wall rotationally matched with the light-converging cylinder and an inner wall fixedly matched with the heat dissipating member and the light-emitting element.

As a further improvement on the present invention, the shield body has a bottom wall. The outer wall is formed by extending upwardly from an outer side edge of the bottom wall. The inner wall is formed by extending upwardly from an inner side edge of the bottom wall. The light-emitting element is located in a spaced region between the inner wall and the outer wall.

As a further improvement on the present invention, the inner wall and the outer wall extend coaxially in the same direction. The upwardly-extending height of the inner wall is greater than the upwardly-extending height of the outer wall.

As a further improvement on the present invention, the outer wall is provided with a plurality of buckling parts protruding toward the direction of a central axis of the illuminating mechanism. The buckling parts are hooked in a fastening groove disposed in the outer side of the heat dissipating member.

As a further improvement on the present invention, the outer wall is further provided with a plurality of intermittently arranged threaded parts. The threaded parts and the buckling parts are alternately arranged in a circumferential direction of the outer wall.

As a further improvement on the present invention, the outer wall is provided with a plurality of uniformly-distributed buckling arms located on the top end thereof. The buckling parts are formed on the top ends of the buckling arms.

As a further improvement on the present invention, the inner wall has a pair of elastic arms extending upwardly and disposed oppositely. Each elastic arm protrudes toward each other to form a limiting part. The heat dissipating member is provided with a horizontally-disposed intermediate wall. The limiting part upwardly passes over the intermediate wall and is supported and limited on the upper surface of the intermediate wall.

As a further improvement on the present invention, the elastic arms extend upwardly and penetrate through the corresponding notches of the light-emitting element, and are inserted into corresponding fixing grooves of the heat dissipating member.

As a further improvement on the present invention, the cover body is assembled above the heat dissipating member and is provided with a positioning column downwardly protruding and fixed in a mounting hole disposed in the heat dissipating member.

In order to realize the above objective according to the present invention, the present invention also provides a focus-adjustable lamp comprising an illuminating mechanism on the top end thereof and a mounting mechanism located on the bottom end thereof. The illuminating mechanism includes a light-emitting element, a shield body shielding the outer side of the light-emitting element, a heat dissipating member closely matched with the light-emitting element and a cover body located on the top end of the illuminating mechanism. The mounting mechanism defines an insertion part inserted downwardly into the ground. The illuminating mechanism further comprises a light-converging cylinder enclosing on the periphery of the shield body, by adjusting the relative position of the light-converging cylinder relative to the shield body in an axial direction, a light spot projected by the light-emitting element on the ground has different sizes.

As a further improvement on the present invention, the shield body is a lens having an outer wall movably matched with the light-converging cylinder and an inner wall unmovably matched with the heat dissipating member and the light-emitting element.

As a further improvement on the present invention, the focus-adjustable lamp further comprises a support rod connecting the illuminating mechanism to the mounting mechanism, and a top end of the support rod is connected and fixed to the illuminating mechanism, and the bottom end of the support rod is connected and fixed with the mounting mechanism.

As a further improvement on the present invention, the shield body has a bottom wall, both of the outer wall and the inner wall are formed by extending upwardly from the bottom wall, the inner wall and the outer wall extend coaxially in the same direction, and spaced apart from each other, the light-emitting element is located in a spaced region between the inner wall and the outer wall.

The light-converging cylinder of the focus-adjustable lamp according to the present invention can rotationally sleeve the outer side of the shield body. The user can effectively and precisely adjust the size of the light spot projected on the ground according to an operational environment.

DETAILED DESCRIPTION

Figure 1:
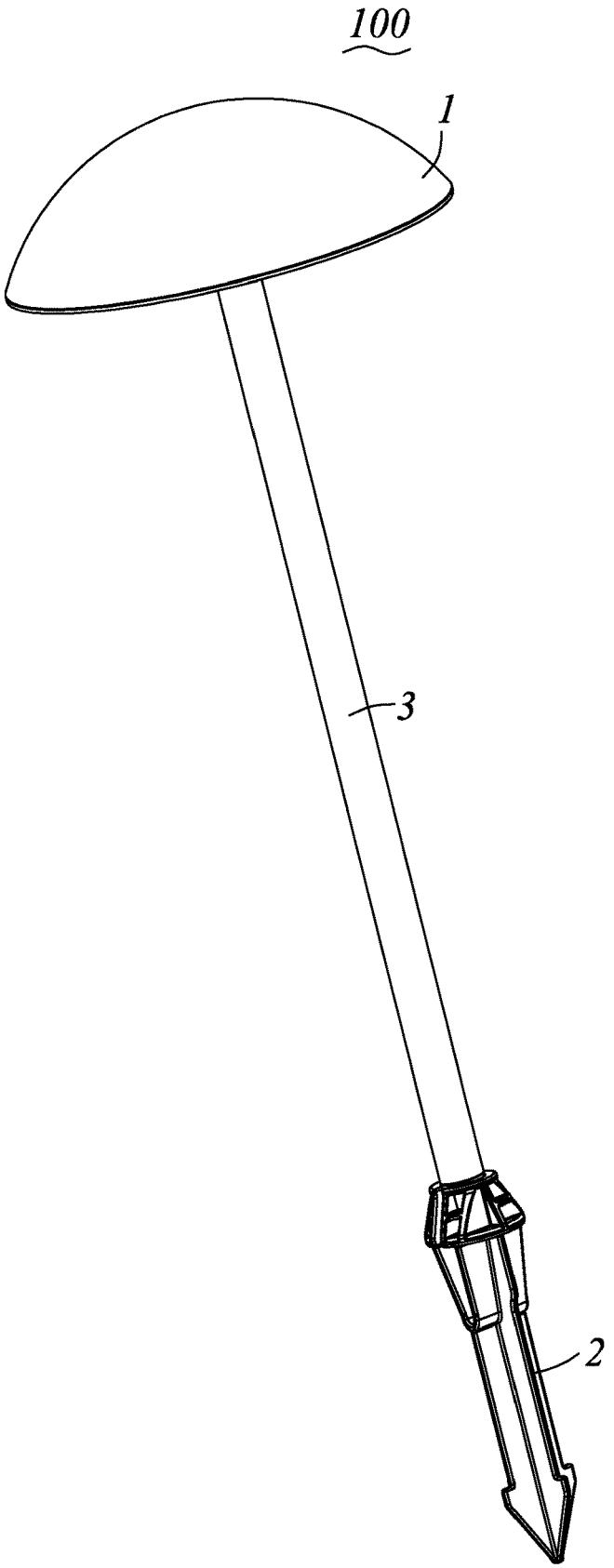
FIG. 1 is a perspective assembled view of a focus-adjustable lamp in a preferred embodiment according to the present invention.

In order to make the objects, technical solutions, and advantages according to the present invention clearer, the present invention will be described in detail below with reference to the specific embodiments and drawings.

FIG. 1 to FIG. 11 show a preferred embodiment of a focus-adjustable lamp 100 according to the present invention. The focus-adjustable lamp 100 according to the present invention comprises an illuminating mechanism 1 on the top end thereof, a mounting mechanism 2 located on the bottom end thereof, and a support rod 3 connecting the illuminating mechanism 1 to the mounting mechanism 2.

Referring to FIG. 3 to FIG. 11, the illuminating mechanism 1 comprises a light-emitting element 11, a shield body 12 shielding the outer side of the light-emitting element 11, a heat dissipating member 13 closely matched with the light-emitting element 11, a light-converging cylinder 14 rotationally sleeving the outer side of the shield body 12 and a cover body 15 located on the top end of the illuminating mechanism 1. The cover body 15 is assembled above the heat dissipating member 13.

Figure 3:
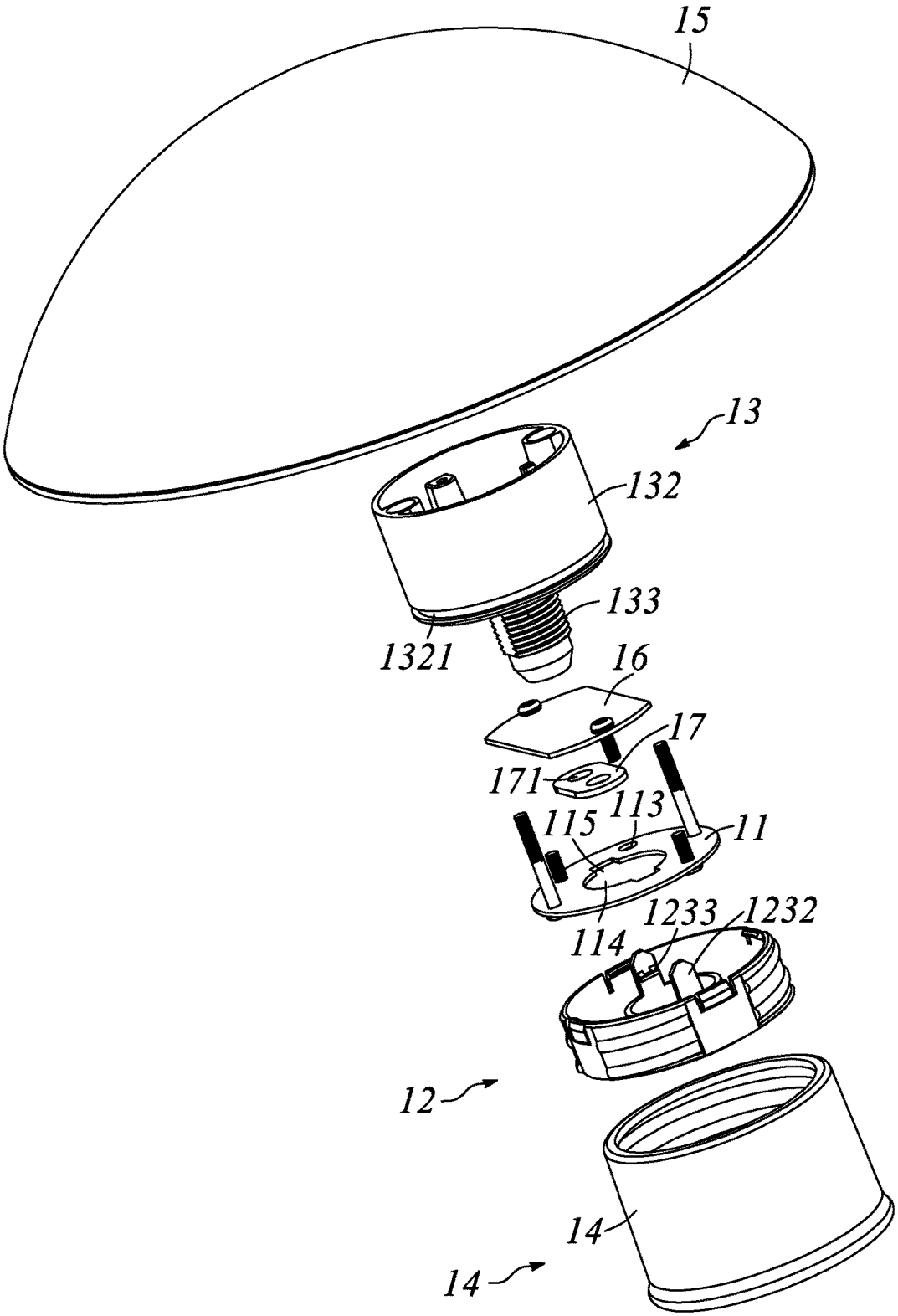
FIG. 3 is a partial exploded view of an illuminating mechanism in the focus-adjustable lamp shown in FIG. 2.
Figure 9:
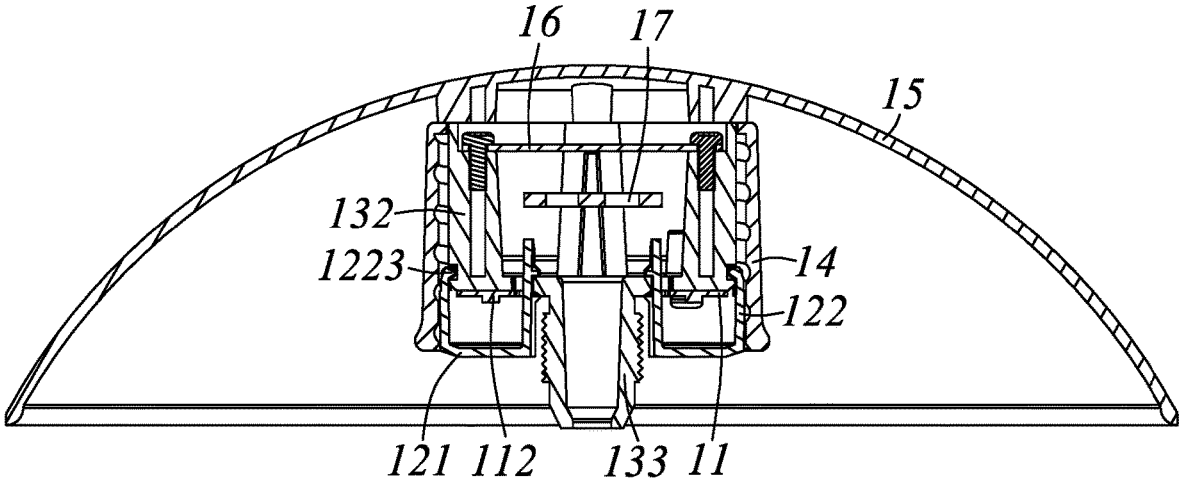
FIG. 9 is a cross-sectional schematic view of the illuminating mechanism shown in FIG. 8.
Figure 11:
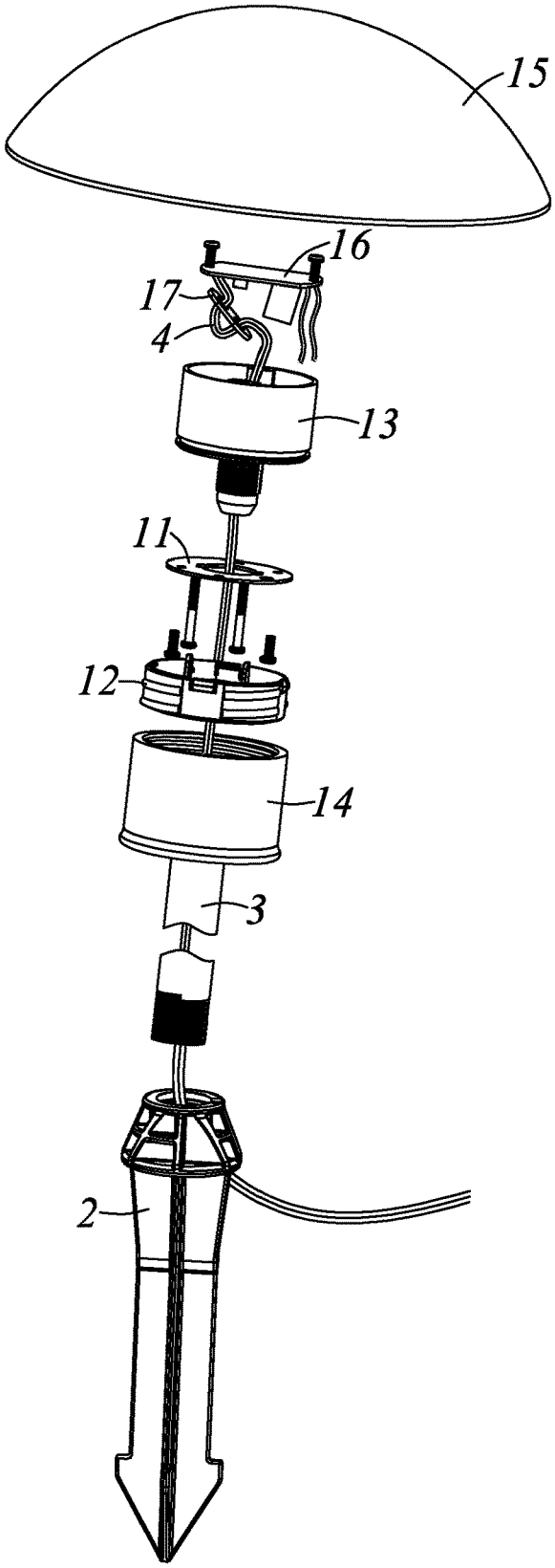
FIG. 11 is an exploded schematic view of the focus-adjustable lamp shown in FIG. 1 after wiring.

Referring to FIG. 3, FIG. 9 and FIG. 11, in the present embodiment, the light-emitting element 11 is an annular lamp panel, the lower surface of which is provided with at least one LED lamp. In the present embodiment, a plurality of LED lamps 112 and a plurality of positioning holes 113 are uniformly distributed in the lower surface of the light-emitting element 11. The central position of the light-emitting element 11 is provided with a receiving hole 114 penetrating therethrough along the thickness direction thereof. The light-emitting element 11 is further provided with a pair of notches 115 communicated with the receiving hole 114. The pair of notches 115 is disposed opposite to each other in the radial direction.

Figure 4:
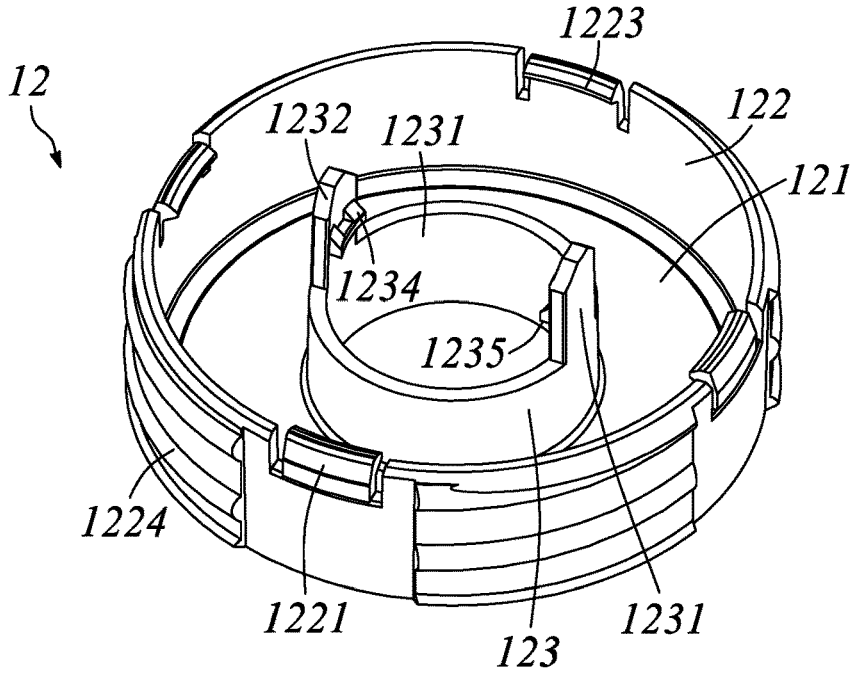
FIG. 4 is a perspective view of a shield body in the illuminating mechanism shown in FIG. 3.
Figure 5:
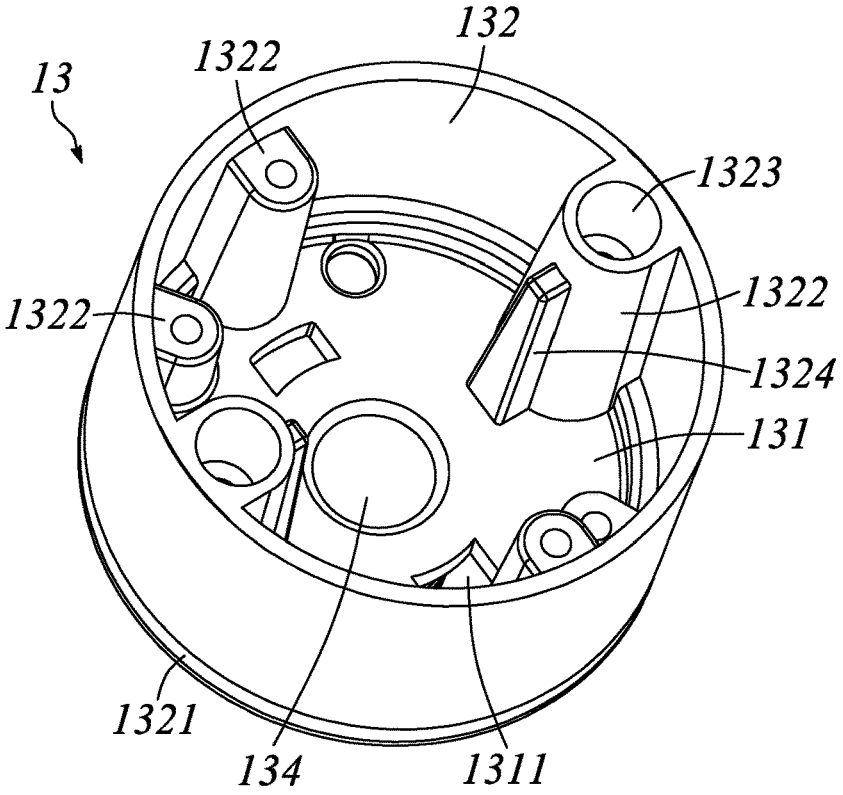
FIG. 5 is a perspective view of a heat dissipating member in the illuminating mechanism shown in FIG. 3.

Referring to FIG. 3, FIG. 4 and FIG. 9, the shield body 12 is a lens. In the present embodiment, the shield body 12 is made of plastic material and has a round outer contour. The shield body 12 has a bottom wall 121, an outer wall 122 formed by extending upwardly from the outer edge of the bottom wall 121, and an inner wall 123 located inside the outer wall 122. The bottom wall 121 is annular. The inner wall 123 extends upwardly from the inner side edge of the bottom wall 121. The inner wall 123 and the outer wall 122 coaxially extend in the same direction. The upwardly-extending height of the inner wall 123 is greater than the upwardly-extending height of the outer wall 122.

The outer wall 122 has a plurality of uniformly-distributed buckling arms 1221 located on the top end thereof and buckling parts 1223 formed on the top ends of the buckling arms 1221. The buckling parts 1223 are located on the free tail ends of the buckling arms 1221 and protrude toward the central axis of the shield body 12. The outer wall 122 is further provided with a plurality of intermittently arranged threaded parts 1224. The threaded parts 1224 and the buckling arms 1221 (or the buckling parts 1223) are alternately disposed in the circumferential direction of the outer wall 122.

The inner wall 123 has an annular base body 1231 and a pair of elastic arms 1232 formed by extending upwardly from the top end of the base body 1231. The pair of elastic arms 1232 is oppositely disposed. Each elastic arm 1232 is provided with a limiting part 1233 facing the other elastic arm 1232. The pair of limiting parts 1233 protrudes toward each other. Each limiting part 1233 has a guiding surface 1234 disposed obliquely and a limiting surface 1235 located below the guiding surface 1234. The guiding surface 1234 extends downwardly and obliquely toward a central axis direction of the shield body 12.

Referring to FIG. 3, FIG. 5, FIG. 7 and FIG. 9, the heat dissipating member 13 has a horizontally-disposed intermediate wall 131, a tubular extending part 132 protruding upwardly from the intermediate wall 131, and a protruding column 133 extending downwardly from the middle part of the intermediate wall 131. The heat dissipating member 13 is further provided with a receiving passage 134 penetrating through both the intermediate wall 131 and the protruding column 133 along a height direction of the dissipating member 13. The receiving passage 134 is located in the central position of the heat dissipating member 13.

A pair of fixing grooves 1311 disposed at an interval penetrates through the intermediate wall 131 along the thickness direction of the intermediate wall 131. The pair of fixing grooves 1311 is disposed in a radial direction and in both sides of the receiving passage 134 symmetrically. The fixing grooves 1311 are disposed by corresponding to the notches 115.

The extending part 132 is cylindrical, and is recessed from the outer surface thereof toward the central axis to form an annular fastening groove 1321. The size of the fastening groove 1321 along the height direction thereof is always consistent. A plurality of bosses 1322 protruding upwardly from an upper surface of the intermediate wall 131 is formed in a receiving cavity of the extending part 132. The boss 1322 has a mounting hole 1323 recessed downwardly. A part of the upper surface of the boss 1322 is flush with the annular upper surface of the extending part 132, and is provided with the mounting hole 1323 penetrating therethrough along the height direction thereof and a convex reinforcing rib 1324 facing the central axis. In addition, the through mounting hole 1323 has an upper section having a larger inner diameter and a lower section having a smaller inner diameter. The upper surface of the other part of the boss 1322 is lower than the annular upper surface of the extending part 132, and serves as a supporting surface to provide a supporting force for a circuit board 16 of the focus-adjustable lamp 100.

Referring to FIG. 3 and FIG. 7 to FIG. 9, the light-converging cylinder 14 is a cylindrical structure having internal threads, and sleeves the outer side of the shield body 12 and the heat dissipating member 13 to completely shield the components therein and to collect and converge the light emitted by the light-emitting element 11. In the present embodiment, the internal threads of the light-converging cylinder 14 are spirally wound from the top end to the bottom end of the inner wall surface thereof.

Figure 6:
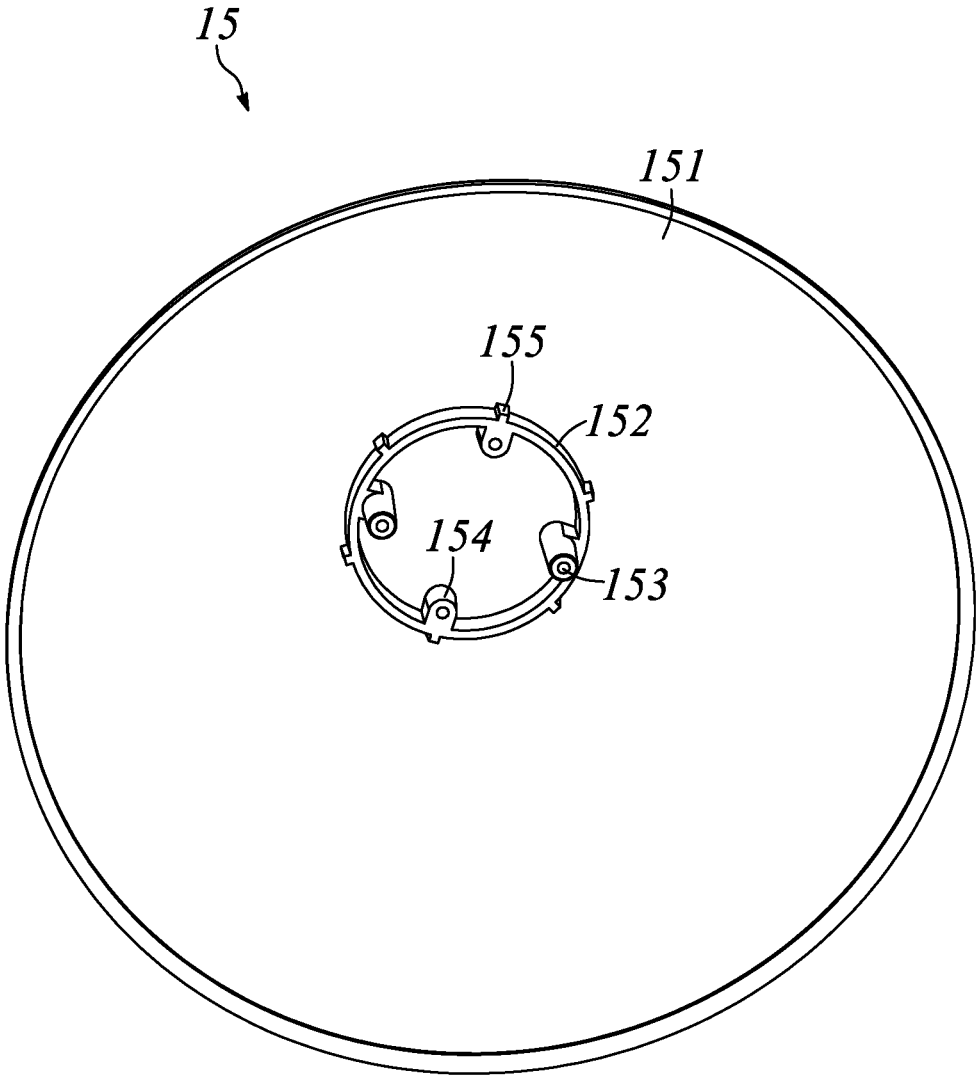
FIG. 6 is a perspective view of a cover body in the illuminating mechanism shown in FIG. 3.
Figure 7:
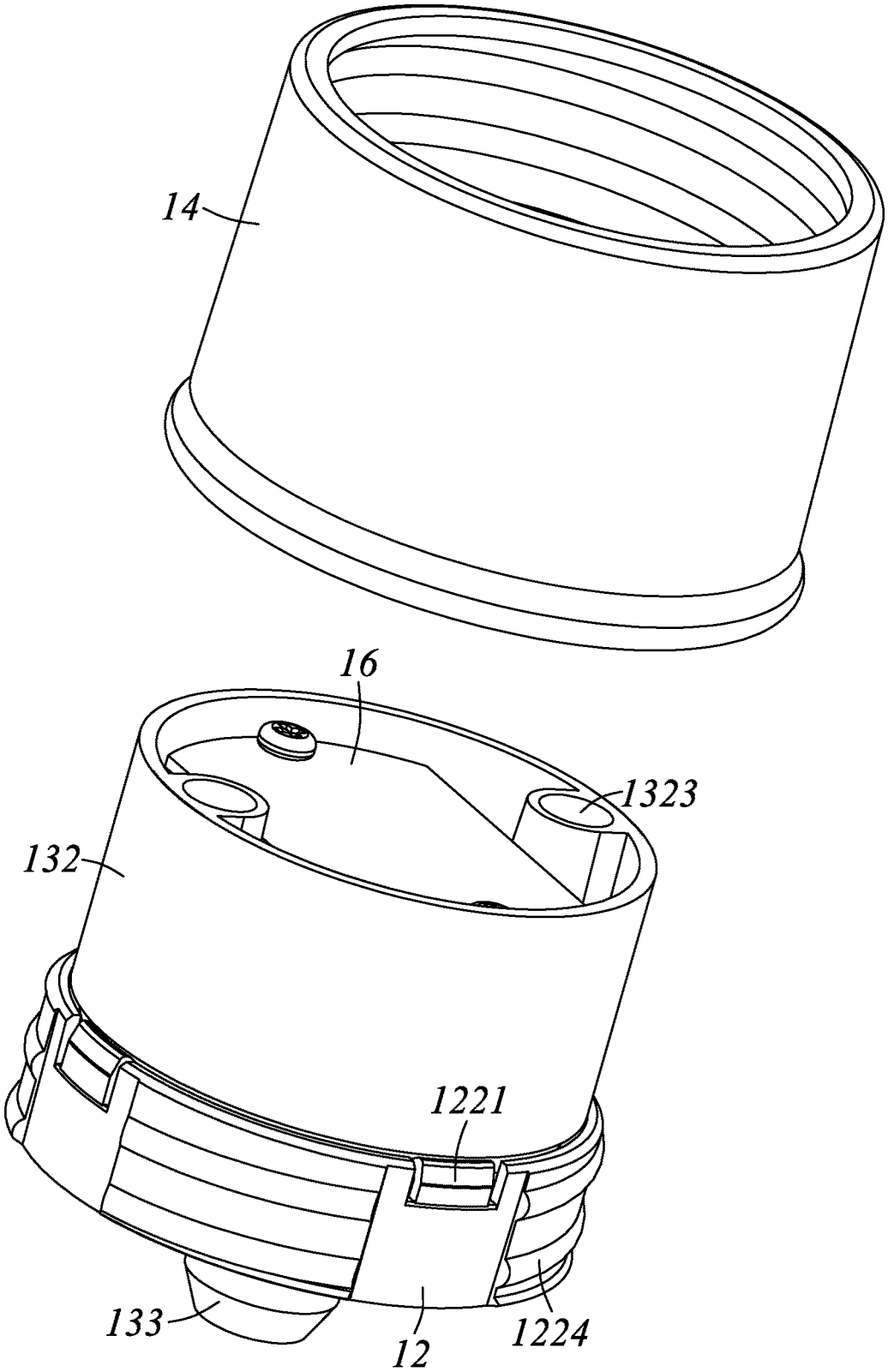
FIG. 7 is a partial assembled view of the illuminating mechanism shown in FIG. 3 after a top cover is removed.

Referring to FIG. 6, the cover body 15 is provided with a top cover 151, an annular protruding part 152 located on the bottom of the top cover 151, and a pair of positioning columns 153. The downwardly-extending length of the positioning columns 153 is greater than the downwardly-extending length of the protruding part 152. The top cover body 151 has an upwardly-arched umbrella-like structure. In the present embodiment, the top surface of the top cover is a spherical surface. The protruding part 152 and the positioning columns 153 are disposed in a concave area on the inner side of the top cover. The positioning columns 153 are symmetrically disposed and a connecting line thereof passes by the center of the top cover 151.

The cover body 15 is further provided with a pair of inner convex parts 154 and a plurality of outer convex parts 155 located on the bottom of the top cover 151. The inner convex parts 154 and the positioning columns 153 are both located inside the protruding part 152 and are arranged alternately. The outer convex parts 155 are evenly distributed on the outer side of the protruding part 152, and the inner convex parts 154 protrude from the inner wall surface of the protruding part 152 toward a direction of the central axis. The outer convex parts 155 are formed by protruding outwardly from an outer circumferential surface of the protruding part 152 toward a direction away from the central axis.

Referring to FIG. 3 and FIG. 11, the focus-adjustable lamp 100 is further provided with a wire buckle 17 for fixing a cable 4. In the present embodiment, the wire buckle 17 is shaped like a flat plate and is provided with a pair of through holes 171, through which the cable 4 penetrates, in a penetrating manner along the thickness direction of the wire buckle 17.

The external cable 4 is electrically connected to the circuit board 16, the light-emitting element 11 and an external power supply unit of the focus-adjustable lamp 100 to supply power to the focus-adjustable lamp 100. When being assembled, the circuit board 16 is placed on the upper surface of the corresponding boss 1322. The wire buckle 17 is located on the lower side of the circuit board 16. Threaded fasteners are inserted into the corresponding mounting holes 1323 from top to bottom to fix the circuit board 16 in the receiving cavity of the heat dissipating member 13. The light-emitting element 11 is closely attached to the lower surface of the intermediate wall 131 by the plurality of threaded fasteners to facilitate the conduction of generated heat.

The shield body 12 sleeves the outer side of the lower part of the extending part 132 of the heat dissipating member 13. The inner wall 123 is fixedly matched with the heat dissipating member 13 and the light-emitting element 11. The light-emitting element 11 is located in a spaced area between the inner wall 123 and the outer wall 122. The buckling part 1223 protrudes toward the direction of the central axis and is hooked in the fastening groove 1321. The elastic arms 1232 of the shield body 12 extend upwardly and penetrate through the notches 115 of the light-emitting element 11, and are inserted into the fixing grooves 1311 of the heat dissipating member 13, thereby preventing relative rotation between the shield body 12 and the heat dissipating member 13. The limiting parts 1233 of the shield body 12 pass over the intermediate wall 131 under the guidance of the guiding surfaces 1234, and the limiting surfaces 1235 are supported and limited on the upper surface of the intermediate wall 131.

The light-converging cylinder 14 rotationally sleeves the outer side of the shield body 12, and accommodates the shield body 12 and the heat dissipating member 13 therein. The cover body 15 is assembled on the upper side of the heat dissipating member 13 from top to bottom. The upper surface of the heat dissipating member 13 is abutted against the lower surface of the protruding part 152 of the cover body 15. The positioning columns 153 are inserted downwardly into the corresponding mounting holes 1323 and are matched with the same in an interfering manner. Thus, the heat dissipating member 13 is assembled and positioned with the cover body 15. The protruding column 133 is inserted downwardly into the top end of the support rod 3. The detachable connection and the fastening cooperation between the heat dissipating member 13 and the support rod 3 are realized by the threads disposed on the outer side of the protruding column 133.

Figure 10:
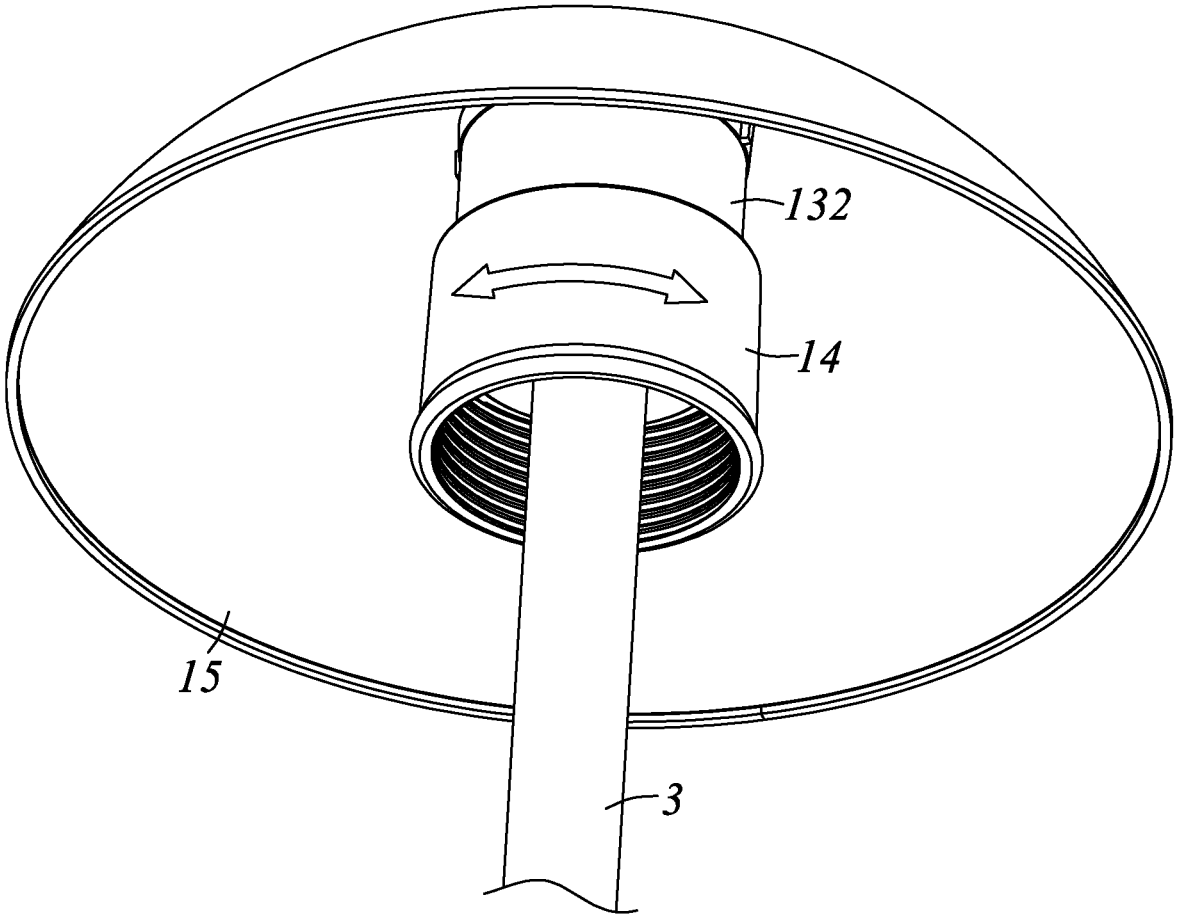
FIG. 10 is a schematic adjusting view of the focus-adjustable lamp shown in FIG.

Referring to FIG. 9 and FIG. 10, the light-converging cylinder 14 can be rotated back and forth along the circumferential direction of the shield body 12 (in the direction as shown in FIG. 10) to adjust the size of the light spot projected on the ground by the light-emitting element 11. When the light-converging cylinder 14 is rotated to the moment that the upper surface thereof is abutted against the bottom surface of the protruding part 152 on the lower side of the cover body 15, the size of the light spot projected by the lamp 100 becomes minimum. When the light-converging cylinder 14 is rotated downward, the light spot projected by the lamp 100 gradually becomes larger, so that the size of the light spot of the lamp 100 can be continuously adjusted by the rotation of the light-converging cylinder 14. In addition, the adjustment is more precise compared with the conventional pulling adjustment on the light spot.

In the present embodiment, since the support rod 3 can be tightly matched with the heat dissipating member 13, and the heat dissipating member 13 is fixedly connected to the shield body 12 without relative rotation, the rotation adjustment of the light-converging cylinder 14 relative to the shield body 12 may also be realized by rotating the support rod 3. In addition, since the cover body 3 can be fixedly matched with the heat dissipating member 13 in an interfering manner, the rotation adjustment of the light-converging cylinder 14 relative to the shield body 12 may also be realized by rotating the cover body 3.

Figure 12:
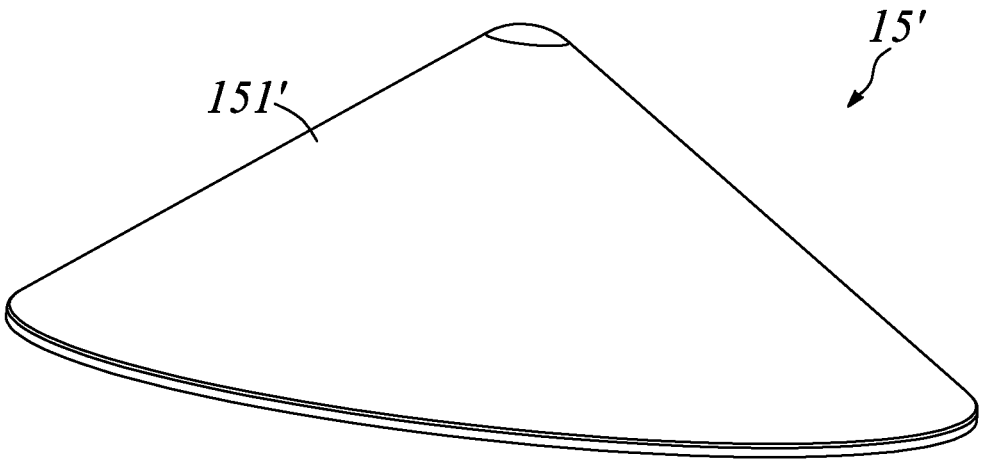
FIGS. 12 to 13 are perspective views of other two embodiments of the cover body in the illuminating mechanism shown in FIG. 3.
Figure 13:
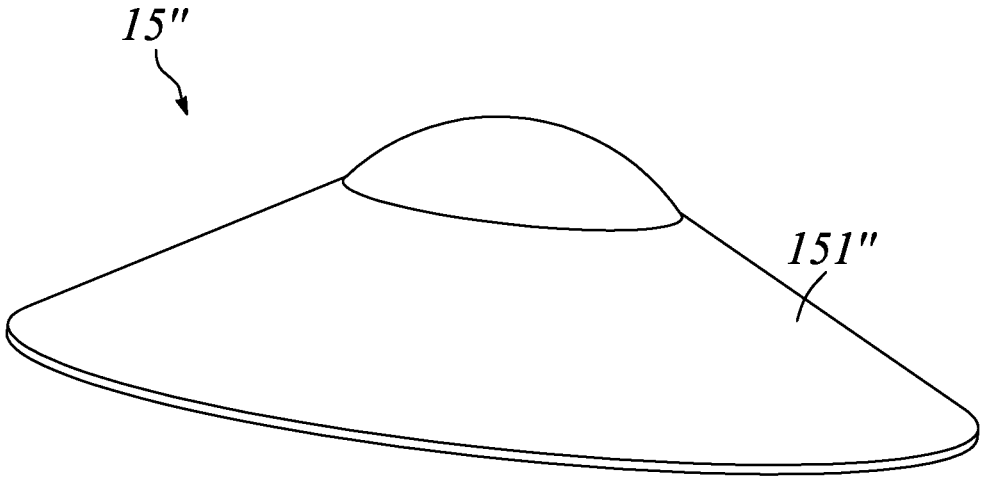

FIG. 12 to FIG. 13 show other two embodiments of the cover body in the focus-adjustable lamp 100 according to the present invention. The basic structure of the cover body 15' shown in FIG. 11 and the cover body 15" shown in FIG. 12 is the same as the basic structure of the cover body 15 in the previous embodiment. The difference is only the shape of the top covers 151' and 151". The top cover 151' has a conical shape, and the top cover 151" is shaped like a straw hat. Other same structures will not be described here.

Figure 2:
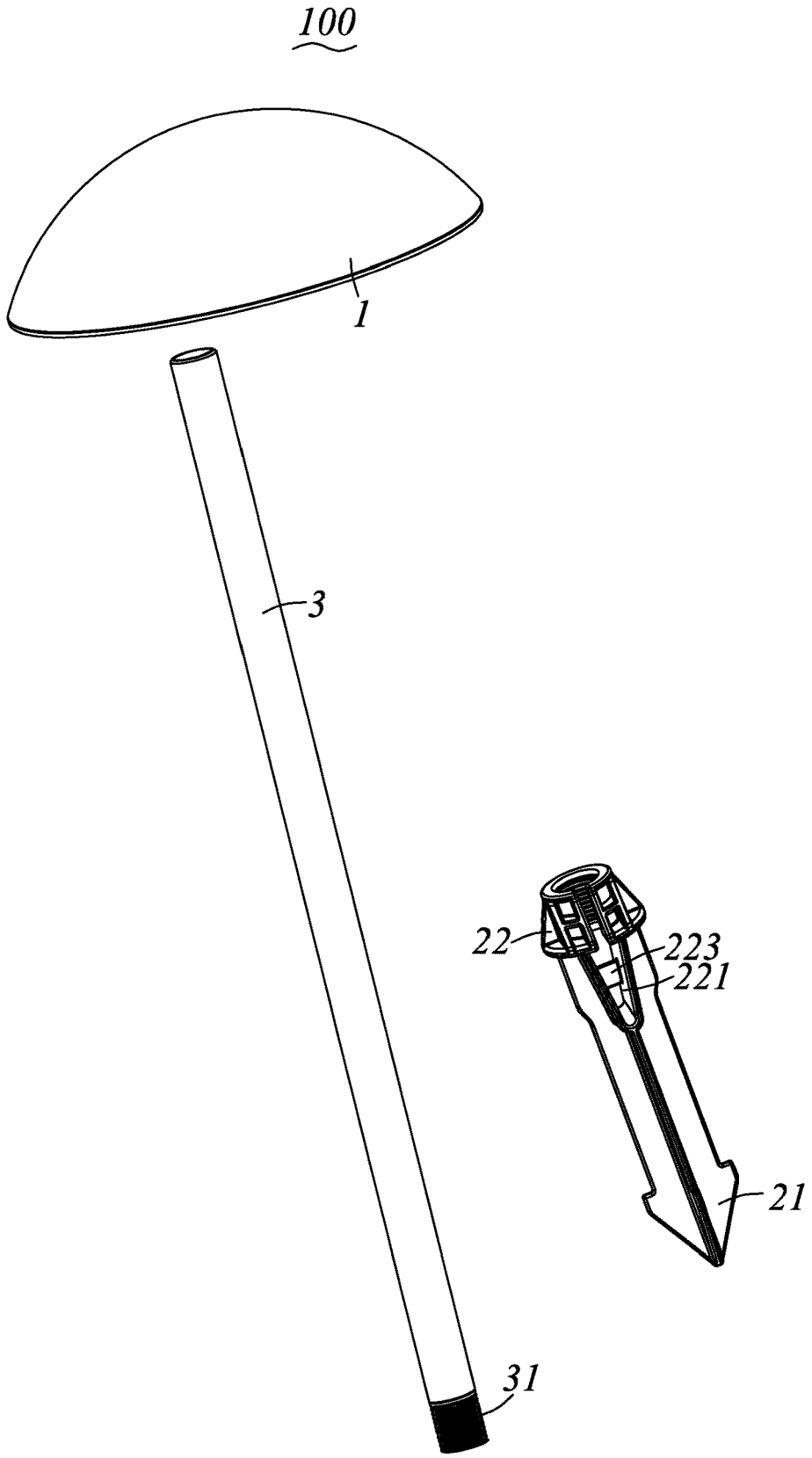
FIG. 2 is a partial exploded view of the focus-adjustable lamp shown in FIG. 1.
Figure 8:
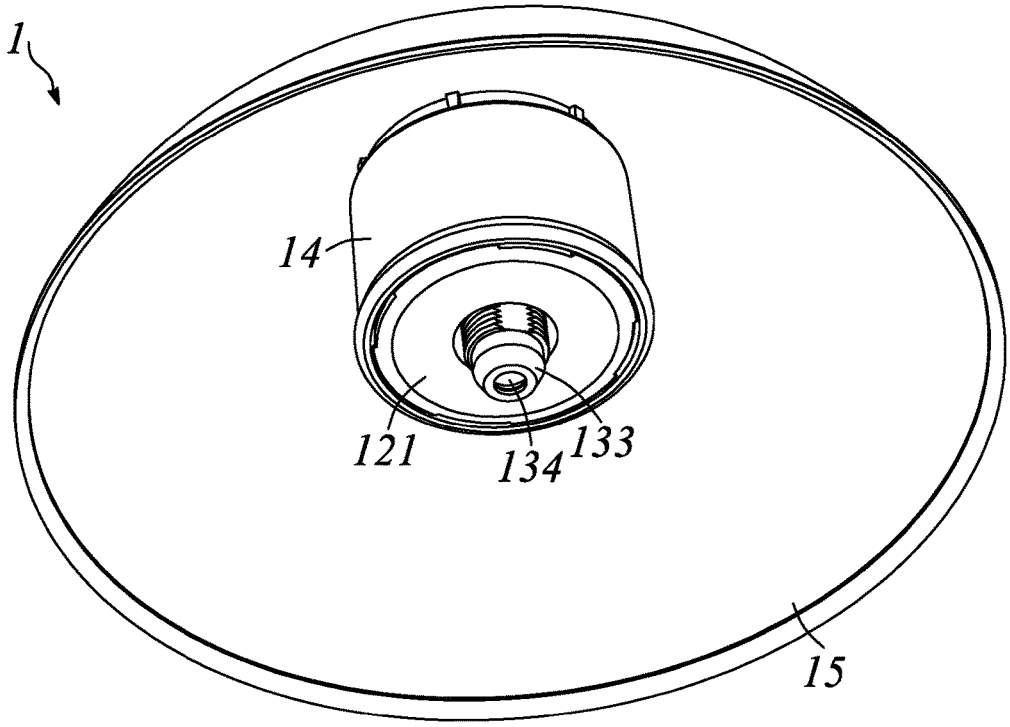
FIG. 8 is a perspective assembled view of the illuminating mechanism shown in FIG. 3.

Referring to FIG. 1, FIG. 2 and FIG. 8, in the present embodiment, the mounting mechanism 2 and the support rod 3 are two structures independent from each other, so as to achieve detachable connection therebetween. In other embodiments, the mounting mechanism 2 may also be directly and integrally disposed on the bottom end of the support rod 3.

The mounting mechanism 2 is an insertion-type structure and is provided with an insertion part 21 on the bottom end thereof and a joint part 22 on the upper side thereof. The joint part 22 is connected to the support rod 3. The insertion part 21 is gradually tapered downwardly from the upper end thereof so as to be inserted downwardly into the ground.

The bottom end of the support rod 3 is inserted into and located in an insertion space (not shown) in the joint part 22. In the present embodiment, the inner wall of the joint part 22 has internal threads matched with the support rod 3. One side of the joint part 22 is recessed from the outer surface thereof toward the central axis thereof to form an opening 221 extending in the height direction. The opening 221 is open to the outside and communicates with the insertion space in the joint part 22. The joint part 22 is further provided with a wire-wrap board 223 located in the insertion space to allow the cable 4 to penetrate out from the lower side of the wire-wrap board 223.

The support rod 3 is a hollow rod-like structure and has two opposite ends, i.e., the top end and the bottom end, disposed in the height direction thereof, wherein one end (the top end) is connected and fixed to the illuminating mechanism 1, and the other end (the bottom end) is connected and fixed with the mounting mechanism 2. In order to reinforce the matching connection with the mounting mechanism 2, the support rod 3 is provided with a connecting part 31 matched with the joint part 22. In the present embodiment, the connecting part 31 is a threaded structure. In other embodiments, the connecting part 31 may also be a buckling-type structure.

When in use, the cable 4 is mechanically and electrically connected to the circuit board 16, penetrates through the wire buckle 17, downwardly penetrates through the receiving passage 134, then enters the tubular space of the support rod 3, and penetrates out from the side part of the mounting mechanism 2 on the lower end of the support rod 3, to be conveniently connected to the external power supply unit.

The above embodiments are only intended for illustrating rather than limiting the technical solutions according to the present invention. Although the present invention is described in detail with reference to the preferred embodiments, it should be understood by those ordinary skilled in the art that the technical solutions according to the present invention can be modified or equivalently substituted without departing from the spirit and scope of the technical solutions.

The invention claimed is:

1. A focus-adjustable lamp, provided with an illuminating mechanism on a top end thereof, the illuminating mechanism comprising:

a light-emitting element;

a shield body shielding an outer side of the light-emitting element;

a heat dissipating member closely matched with the light-emitting element; and a cover body located on the top end of the illuminating mechanism, wherein the illuminating mechanism is further provided with a light-converging cylinder rotationally sleeving the outer side of the shield body, and the light-converging cylinder is capable of rotating back and forth along a circumferential direction of the shield body to adjust a size of a light spot projected by the light-emitting element on a ground, the shield body comprising a lens having an outer wall rotationally matched with the light-converging cylinder and an inner wall fixedly matched with the heat dissipating member and the light-emitting element, the shield body has a bottom wall, the outer wall is formed by extending upwardly from an outer side edge of the bottom wall, the inner wall is formed by extending upwardly from an inner side edge of the bottom wall, and the light-emitting element is located in a spaced region between the inner wall and the outer wall.

2. The focus-adjustable lamp according to claim 1, wherein the inner wall and the outer wall extend coaxially in a same direction, and an upwardly-extending height of the inner wall is greater than an upwardly-extending height of the outer wall.

3. The focus-adjustable lamp according to claim 1, wherein the outer wall is provided with a plurality of buckling parts protruding toward a direction of a central axis of the illuminating mechanism, and the buckling parts are hooked in a fastening groove disposed in an outer side of the heat dissipating member.

4. The focus-adjustable lamp according to claim 3, wherein the outer wall is further provided with a plurality of intermittently arranged threaded parts, and the threaded parts and the buckling parts are alternately arranged in a circumferential direction of the outer wall.

5. The focus-adjustable lamp according to claim 3, wherein the outer wall is provided with a plurality of uniformly-distributed buckling arms located on the top end thereof, and the buckling parts are formed on top ends of the buckling arms.

6. The focus-adjustable lamp according to claim 5, wherein the inner wall has a pair of elastic arms extending upwardly and disposed oppositely, each elastic arm protrudes toward the other to form a limiting part, the heat dissipating member is provided with a horizontally-disposed intermediate wall, and the limiting part upwardly passes over the intermediate wall and is supported and limited on an upper surface of the intermediate wall.

7. The focus-adjustable lamp according to claim 6, wherein the elastic arms extend upwardly and penetrate through corresponding notches of the light-emitting element, and are inserted into corresponding fixing grooves of the heat dissipating member.

8. The focus-adjustable lamp according to claim 1, wherein the cover body is assembled above the heat dissipating member and is provided with a positioning column protruding downwardly and fixed in a mounting hole disposed in the heat dissipating member.

9. A focus-adjustable lamp, comprising:

an illuminating mechanism on a top end thereof, and the illuminating mechanism including a light-emitting element, a shield body shielding an outer side of the light-emitting element, a heat dissipating member closely matched with the light-emitting element and a cover body located on the top end of the illuminating mechanism; and a mounting mechanism located on a bottom end thereof, and defining an insertion part inserted downwardly into a ground, wherein the illuminating mechanism further comprises a light-converging cylinder enclosing on a periphery of the shield body, by adjusting a relative position of the light-converging cylinder relative to the shield body in an axial direction, a light spot projected by the light-emitting element on the ground has different sizes, the shield body is a lens having an outer wall movably matched with the light-converging cylinder and an inner wall unmovably matched with the heat dissipating member and the light-emitting element, the shield body has a bottom wall, both of the outer wall and the inner wall are formed by extending upwardly from the bottom wall, the inner wall and the outer wall extend coaxially in the same direction, and spaced apart from each other, and the light-emitting element is located in a spaced region between the inner wall and the outer wall.

10. The focus-adjustable lamp according to claim 9, wherein the focus-adjustable lamp further comprises a support rod connecting the illuminating mechanism to the mounting mechanism, and a top end of the support rod is connected and fixed to the illuminating mechanism, and the bottom end of the support rod is connected and fixed with the mounting mechanism.

11. A focus-adjustable lamp, providing with an illuminating mechanism on a top end thereof, the illuminating mechanism comprising:

a light-emitting element;

a shield body shielding an outer side of the light-emitting element;

a heat dissipating member closely matched with the light-emitting element; and a cover body located on the top end of the illuminating mechanism, wherein the illuminating mechanism is further provided with a light-converging cylinder rotationally sleeving the outer side of the shield body, and the light-converging cylinder is capable of rotating back and forth along a circumferential direction of the shield body to adjust a size of a light spot projected by the light-emitting element on a ground, the shield body comprising a lens having an outer wall rotationally matched with the light-converging cylinder and an inner wall fixedly matched with the heat dissipating member and the light-emitting element, the outer wall is provided with a plurality of buckling parts protruding toward a direction of a central axis of the illuminating mechanism and a plurality of intermittently arranged threaded parts, and the buckling parts are hooked in a fastening groove disposed in an outer side of the heat dissipating member, the threaded parts and the buckling parts are alternately arranged in a circumferential direction of the outer wall.

* * * * *